US007639242B2

(12) United States Patent
Urushibata

(10) Patent No.: US 7,639,242 B2
(45) Date of Patent: Dec. 29, 2009

(54) DRIVING CIRCUIT OF DISPLAY DEVICE, DISPLAY DEVICE AND DRIVING CONTROL METHOD OF DISPLAY DEVICE

(75) Inventor: Eiichi Urushibata, Tokyo (JP)

(73) Assignee: Panasonic Corporation, Osaka (JP)

( * ) Notice: Subject to any disclaimer, the term of this patent is extended or adjusted under 35 U.S.C. 154(b) by 618 days.

(21) Appl. No.: 11/229,517

(22) Filed: Sep. 20, 2005

(65) Prior Publication Data

US 2006/0061522 A1 Mar. 23, 2006

(30) Foreign Application Priority Data

Sep. 22, 2004 (JP) ..... 2004-275485

(51) Int. Cl.
*G09G 5/00* (2006.01)

(52) U.S. Cl. ..... 345/204; 345/98

(58) Field of Classification Search ..... 345/204, 345/98

See application file for complete search history.

(56) References Cited

U.S. PATENT DOCUMENTS 3,869,644 A * 3/1975 Yano et al. ..... 315/169.4
5,534,774 A * 7/1996 Moore et al. ..... 324/158.1
5,852,406 A * 12/1998 Edde et al. ..... 340/825.2
6,583,771 B1 * 6/2003 Furuhashi et al. ..... 345/1.1
6,628,214 B1 * 9/2003 Kawase et al. ..... 341/100
7,102,610 B2 * 9/2006 Ludden ..... 345/98

OTHER PUBLICATIONS

"Plasma Display Panel Scan Driver,"—URL: http//www.st-japan.co.jp/data/adv/20000406_prod1_pdp/pdf/stv7617.pdf- Sep. 8, 2004.
:For PDP Developers,—URL: http//www.st-japan.co.jp/data/adv/20000406_prod1_pdp/prod1_pdp.html- Sep. 8, 2004.

* cited by examiner

*Primary Examiner*—Amare Mengistu
*Assistant Examiner*—Premal Patel
(74) *Attorney, Agent, or Firm*—Sughrue Mion, PLLC

(57) ABSTRACT

A circuit includes a driver for outputting an image signal to a display, and a controller for controlling an operation of the driver on the basis of an input image signal. The controller includes a control signal generator for generating control signals of plural kinds on the basis of the image signal; and a serial data generator for converting at least two of the control signals of plural kinds generated by the control signal generator into serial data, and the driver includes a serial/parallel converter for separating the serial data outputted from the controller as the control signal.

5 Claims, 14 Drawing Sheets

FIG. 5

| LSB | | | | | MSB |
|---|---|---|---|---|---|
| 1 | 2 | 3 | 4 | 5 | 6 |
| CLK | DATA | CLR | BLK1 | BLK2 | LE |

FIG. 7A

FIG. 7B

DRIVING CIRCUIT OF DISPLAY DEVICE, DISPLAY DEVICE AND DRIVING CONTROL METHOD OF DISPLAY DEVICE

BACKGROUND OF THE INVENTION

1. Field of the Invention

The present invention relates to a driving circuit for performing driving control of a display device, a display device having the driving circuit and a driving control method of the display device.

2. Description of Related Art

In a Plasma Display Panel (hereinafter, referred to as "PDP"), it is essential to perform a floating operation due to problems associated with breakdown voltage characteristics of a scan driver.

All signals input to the scan driver need to be electrically insulated and, accordingly, insulating means are provided for this purpose. One example of the insulting means is a photocoupler, which is currently used in almost every PDP.

However, since the photocoupler is a very expensive device and a conventional PDP driving circuit requires a number of photocouplers along an input signal transfer path to the scan driver of the PDP, manufacturing costs of the conventional PDP driving circuit are increased considerably.

FIG. 11 is a signal processing block diagram of a conventional plasma display device 100.

Referring to FIG. 11, the plasma display device 100 is comprised of a PDP 101 which is a display unit for displaying an image, a control circuit 102 for controlling image display in the PDP 101, a first sustain discharge pulse generation circuit 103 for generating a sustain discharge pulse under the control of the control circuit 102 and outputting the sustain discharge pulse to the PDP 101, a second sustain discharge pulse generation circuit 104 for generating a sustain discharge pulse under the control of the control circuit 102 and outputting the sustain discharge pulse to a scan pulse generation circuit 107 (to be described later), a data driver 105 for transmitting display data to the PDP 101 under the control of the control circuit 102, a scan driver controller 106 under the control of the control circuit 102for controlling the scan driver, and a scan pulse generation circuit 107 for generating the scan pulse, outputting the scan pulse to the PDP 101, and driving a scan electrode of the PDP 101 under the control of the scan driver controller 106 and second sustain discharge pulse generation circuit 104.

FIG. 12 is a block diagram showing a partial structure of the scan driver controller 106 and the scan pulse generation circuit 107 in the plasma display device 100 shown in FIG. 11.

Referring to FIG. 12, the scan driver controller 106 is comprised of a first buffer circuit group 108 consisting of a plurality of buffer circuits 112, a photocoupler group 109 consisting of a plurality of photocouplers 113, and a second buffer circuit group 110 consisting of a plurality of buffer circuits 114. Further, the buffer circuits 112 included in the first buffer circuit group 108, the photocouplers 113 included in the photocoupler group 109 and the buffer circuits 114 included in the second buffer circuit group 110 are provided in equal number. For example, in the example shown in FIG. 12, 6 of each are provided.

Further, the scan pulse generation circuit 107 is comprised of a plurality of scan drivers 111.

The scan driver controller 106 generates control signals of plural kinds (for example, 6 kinds in the example shown in FIG. 12), such as a first blank signal BLK1, a second blank signal BLK2, a latch enable signal LE, a clear signal CLR, a data signal DATA and a clock signal CLK.

The scan driver controller 106 has signal transfer paths for respective control signals so as to output control signals of the plural kinds with respect to the scan driver 111 of the scan pulse generation circuit 107 in parallel.

That is, the scan driver controller 106 has, for example, 6 signal transfer paths, a first signal transfer path 121 functioning as a transfer path of the first clock signal BLK1, a second signal transfer path 122 functioning as a transfer path of the second blank signal BLK2, a third signal transfer path 123 functioning as a transfer path of the latch enable signal LE, a fourth signal transfer path 124 functioning as a transfer path of the clear signal CLR, a fifth signal transfer path 125 functioning as a transfer path of the data signal DATA and a sixth signal transfer path 126 functioning as a transfer path of the clock signal CLK.

The first to sixth signal transfer paths 121 to 126 have a buffer circuit 112, a photocoupler 113 and a buffer circuit 114, respectively, in the transfer direction of the control signal in the order described here.

The photocoupler 113 electrically isolates an upper stream side of the photocoupler 113 as the boundary from the downstream side thereof in each of the signal transfer paths 121 to 126.

Further, the first to sixth signal transfer paths 121 to 126 are connected to plural scan drivers 111, respectively.

FIG. 13 is a block diagram showing a construction of a conventional scan driver 111.

Referring to FIG. 13, the scan driver 111 has a shift register circuit group 131, a latch circuit group 132, and n output circuits 133 for outputting corresponding driving signals (scan pulses) with respect to n scan electrodes (gate electrodes) included in the PDP 101, respectively.

FIG. 14 is a timing chart showing signal waveforms of a control signal input to the scan driver 111 from the scan driver controller 106 and an output signal (scan pulses) from the scan driver 111.

Referring to FIG. 14, the scan driver 111 has, for example, a data signal DATA, a clock signal CLK, a clear signal CLR, a latch enable signal LE, a first blank signal BLK1 and a second blank signal BLK2 that are input to the scan driver 111. Further, the scan driver 111 outputs an output signal OUT, that is, a scan pulse to the scan electrode of the PDP 101.

Among them, the clock signal CLK, the clear signal CLR, the data signal DATA, the first blank signal BLK1 and the second blank signal BLK2 are input to the shift register circuit group 131, and the latch enable signal LE is input to the latch circuit group 132.

Further, the scan driver 111 inputs a high level (H) signal only to the DATA terminal of the shift register circuit group 131 initially, and then a low level (L) signal afterwards, as shown in FIG. 14. The data indicated by the high level (H) signal sequentially shifts an interior of the shift register circuit group 131 in synchronization with the clock signal input to the CLK terminal. At this time, the latch circuit group 132 is in the latch enable state, and the output of the latch circuit group 132 becomes a sequence high level (H) in synchronization with a shift of data indicated by the high level (H) signal in the interior of the shift register circuit group 131. As such, only one output out of the outputs of the latch circuit group 132 becomes the sequence high level (H).

As a result, n output circuits 133 output respective output signals OUT with respect to n scan electrodes (gate electrodes) included in the PDP 101.

Further, the following documents 1 and 2 are non-patent, exemplary technical documents for a conventional scan driver.

URL:
http://www.st-japan.co.jp/data/adv/20000406_prod1_pdp/pdf/stv7617.pdf found on the Internet on Sep. 8, 2004.

URL:
http://www.st-japan.co.jp/data/adv/20000406_prod1_pdp/prod1_pdp.html found on the Internet on Sep. 8, 2004.

In the conventional plasma display device 100, control signals of plural kinds such as a data signal DATA, a clock signal CLK, a clear signal CLR, a latch enable signal LE, and a blank signal BLK are transmitted from the scan driver controller 106 to the scan pulse generation circuit 107 in parallel, and the scan driver 111 is also configured on the basis of such parallel data transmission.

Accordingly, the scan driver controller 106 and scan driver 111 respectively required independent signal transfer paths to transmit the control signals of the plural kinds in the conventional art. That is, since there were so many control signals for the scan driver 111 to process, there were a correspondingly large number of signal transfer paths.

Furthermore, there is a need to arrange the photocoupler 113 on every signal transfer path.

Accordingly, it is not possible to prevent the size of the conventional PDP 101 driving circuit from being enlarged and it is not possible to reduce manufacturing costs thereof.

SUMMARY OF THE INVENTION

Therefore, an object of the present invention is to address the problems as described above.

According to an aspect of the present invention, there is provided a driving circuit of a display device having a driver for outputting an image signal to a display for displaying an image, and a controller for controlling an operation of the driver on the basis of an input image signal, wherein the controller comprises a control signal generator for generating control signals of plural kinds on the basis of the image signal, and a serial data generator for converting at least two of the control signals of plural kinds generated by the control signal generator into serial data, and the driver comprises a serial/parallel converter for separating the serial data outputted from the controller as the control signal of the plural kinds.

According to another aspect of the present invention, there is provided a display device having a driving circuit described in anyone of claims 1 to 8, and a display for being driven by the driving circuit and for displaying an image on the basis of the image signal.

According to yet another aspect of the present invention, there is provided a method for driving and controlling a display device using a driver for outputting an image signal to a display for displaying an image, and a controller for controlling operation of the driver on the basis of an input image signal, the method comprising a control signal producing step wherein the controller produces control signals of plural kinds on the basis of the image signal; a serial data producing step for converting at least two control signals of the control signals of plural kinds produced by the control signal producing step into serial data; an outputting step wherein the controller outputs the serial data to the driver; and a serial/parallel conversion step wherein the driver separates the serial data into a control signal of the plural kinds.

BRIEF DESCRIPTION OF THE DRAWINGS

The above and other features and advantages of the present invention will become more apparent by describing in detail exemplary embodiments thereof with reference to the attached drawings in which:

FIG. 5 is a view showing a signal format of serial data used in the plasma display device in accordance with the first embodiment of the present invention;

FIGS. 7A, 7B are showing signal format of the control signal used in the plasma display device in accordance with the second embodiment of the present invention;

DETAILED DESCRIPTION OF THE INVENTION

Figure 1:
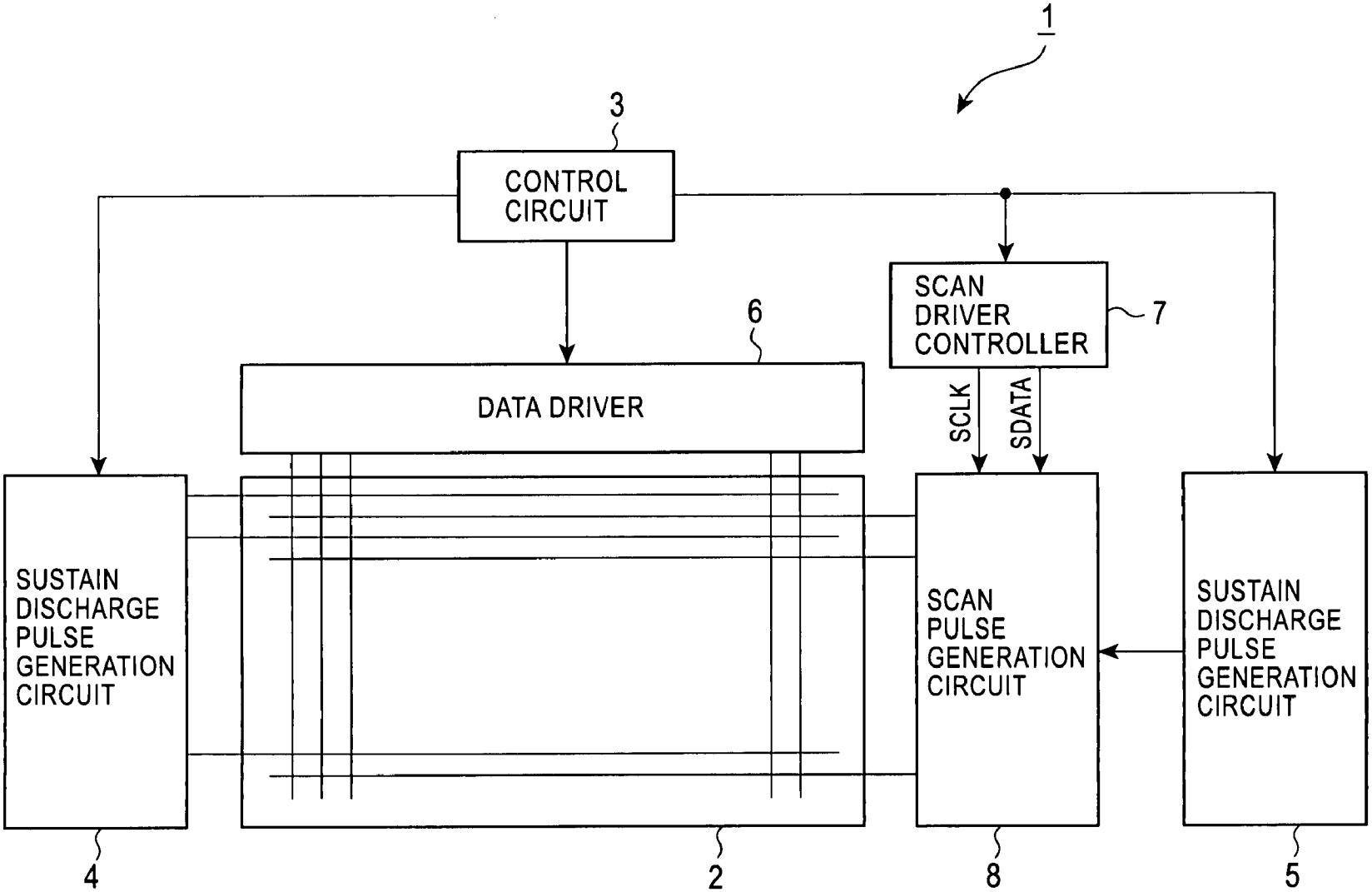
FIG. 1 is a signal processing block diagram of a plasma display device in accordance with a first embodiment of the present invention.

Exemplary embodiments according to the present invention will now be described in detail with reference to the accompanying drawings.

A driving circuit of a display device according to a preferred embodiment of the present invention includes a driver for outputting an image signal to a display for displaying an image, and a controller for controlling operation of the driver on the basis of an input image signal, the controller comprising a control signal generator for generating control signals of plural kinds on the basis of the image signal, and a serial data generator for converting at least two of the control signals of plural kinds generated by the control signal generator into serial data, and the driver comprising a serial/parallel converter for separating the serial data outputted from the controller as the control signal of the plural kinds.

The driving circuit of the display device in accordance with the present embodiment generates the control signals of plural kinds to perform operational control of the driver, converts at least two signals out of the generated control signals of plural kinds into serial data and outputs the data to the driver, that is, transmits the data serially.

The control signals of plural kinds are output to the driver from the controller in parallel in the conventional driving control circuit. However, according to the present embodiment, it is possible to reduce the number of transfer paths of the control signals between the serial data generator that converts the control signals of plural kinds into serial data and the driver, compared with the conventional driving control circuit.

For example, as described in an embodiment to be described below, it is possible to drive and control the driver using two control signals converted into serial data. In the conventional driving control circuit, it is possible to reduce (S−2) signal transfer paths by making the number of the control signals outputted in parallel S (typically, S is 6 or more).

Accordingly, the cost of the driving circuit can be reduced in correspondence to the reduced number of the transfer paths of the control signals, and the size of the circuit can be reduced, simultaneously.

Preferably, in the driving circuit of the display device in accordance with the present embodiment, the controller includes an insulator to electrically insulate an upper stream side of a signal transfer path of the plural control signals or the serial data from a down stream side, the signal transfer path being extended from the control signal generator to the serial data generator.

In the driving circuit of the display device in accordance with the present embodiment, although it is preferred that the insulator consist of a photodriver, a pulse driver may also be used.

As such, since the insulator is comprised of expensive devices such as photocouplers, or pulse drivers, it is possible to reduce the number of the necessary insulators and reduce the manufacturing costs of the driving circuit considerably by applying the present embodiment to the driving circuit having such an insulator.

Preferably, in the driving circuit of the display device according to the present embodiment, one of the control signals of plural kinds generated by the control signal generator is a clock signal, and the serial data generator converts all control signals except the clock signal into serial data. In this case, it is permitted that only the clock signal and serial data are outputted to the driver and it is sufficient that the number of signal transfer paths from the controller to the driver is two, so that costs and circuit size can be further reduced. Further, since it is permitted that only the clock signal and serial data are outputted to the driver and it is unnecessary for other data or signals to be transmitted to the driver, the transmission time and clock frequency can be reduced. Further, Electro-Magnetic Interference (EMI) can be improved by reducing the clock frequency.

Further, while the signal has to be transmitted within the scan time, since the transmission time of the control signal is extended with only parallel to serial control signal conversion in the prior art, it is not possible to complete signal transmission within the scan time. In order to solve this problem, the frequency of the transmission signal must be raised. However, if the frequency of the transmission signal is raised, the EMI becomes deteriorated and it is difficult to perform signal transmission over a long signal transmission path. According to the present embodiment, it is possible to reduce the number of the control signal transfer paths without encountering such problems.

Preferably, in the driving circuit of the display device according to the present embodiment, the driver defines start and end time points of the driving signal to drive scan electrodes on the display by combining a high level or a low of the clock signal issued from the controller and a high level or a low level of the signal indicating the serial data issued from the controller.

Preferably, in the driving circuit of the display device according to the present embodiment, the control signals of the plural kinds include an ID signal used to determine which driver is controlled by which of the control signals of the plural kinds.

Preferably, in the driving circuit of the display device according to the present embodiment, the driver has a signal determining portion to determine whether the driver is controlled by the control signal on the basis of the ID signal or not.

Preferably, in the driving circuit of the display device according to the present embodiment, the driver includes a synchronizer to synchronize the serial data output from the controller.

Preferably, in the driving circuit of the display device according to the present embodiment, the circuit includes a driving circuit according to the present embodiment, and a display driven by the driving circuit, for displaying an image on the basis of the image signal.

In a method for driving and controlling a display device using a driver for outputting an image signal to a display for displaying an image, and a controller for controlling operation of the driver on the basis of an input image signal, the method comprises a control signal producing step wherein the controller produces control signals of plural kinds on the basis of the image signal; a serial data producing step for converting at least two control signals of the control signals of plural kinds produced by the control signal producing step into serial data; an outputting step wherein the controller outputs the serial data to the driver; and a serial/parallel conversion step wherein the driver separates the serial data into a control signal of the plural kinds.

First Embodiment

FIG. 1 is a signal processing block diagram showing a plasma display device (also simply referred to as "display device") in accordance with a first embodiment of the present invention.

Referring to FIG. 1, a plasma display device 1 in accordance with a first embodiment is comprised of a plasma display panel (hereinafter, also referred to as a PDP) 2 as a display, a control circuit 3 for controlling image display in the PDP 2, a first sustain discharge pulse generation circuit 4 for generating a sustain discharge pulse under the control of the control circuit 3 and outputting the sustain discharge pulse to the PDP 2, a second sustain discharge pulse generation circuit 5 for generating a sustain discharge pulse under the control of the controller 3 and outputting the sustain discharge pulse to a scan pulse generation circuit 8 (to be described later), a data driver 6 for transmitting display data to the PDP 2 under the control of the control circuit 3, a scan driver controller 7 for controlling scan drivers 20-1 to 20-m (referring to FIGS. 2 and 3) under the control of the control circuit 3, and a scan pulse generation circuit 8 for generating a scan pulse under the control of the scan driver controller 7 and the second sustain discharge pulse generation circuit 5, outputting the scan pulse to the PDP 2, and driving a scan electrode of the PDP 2.

Figure 2:
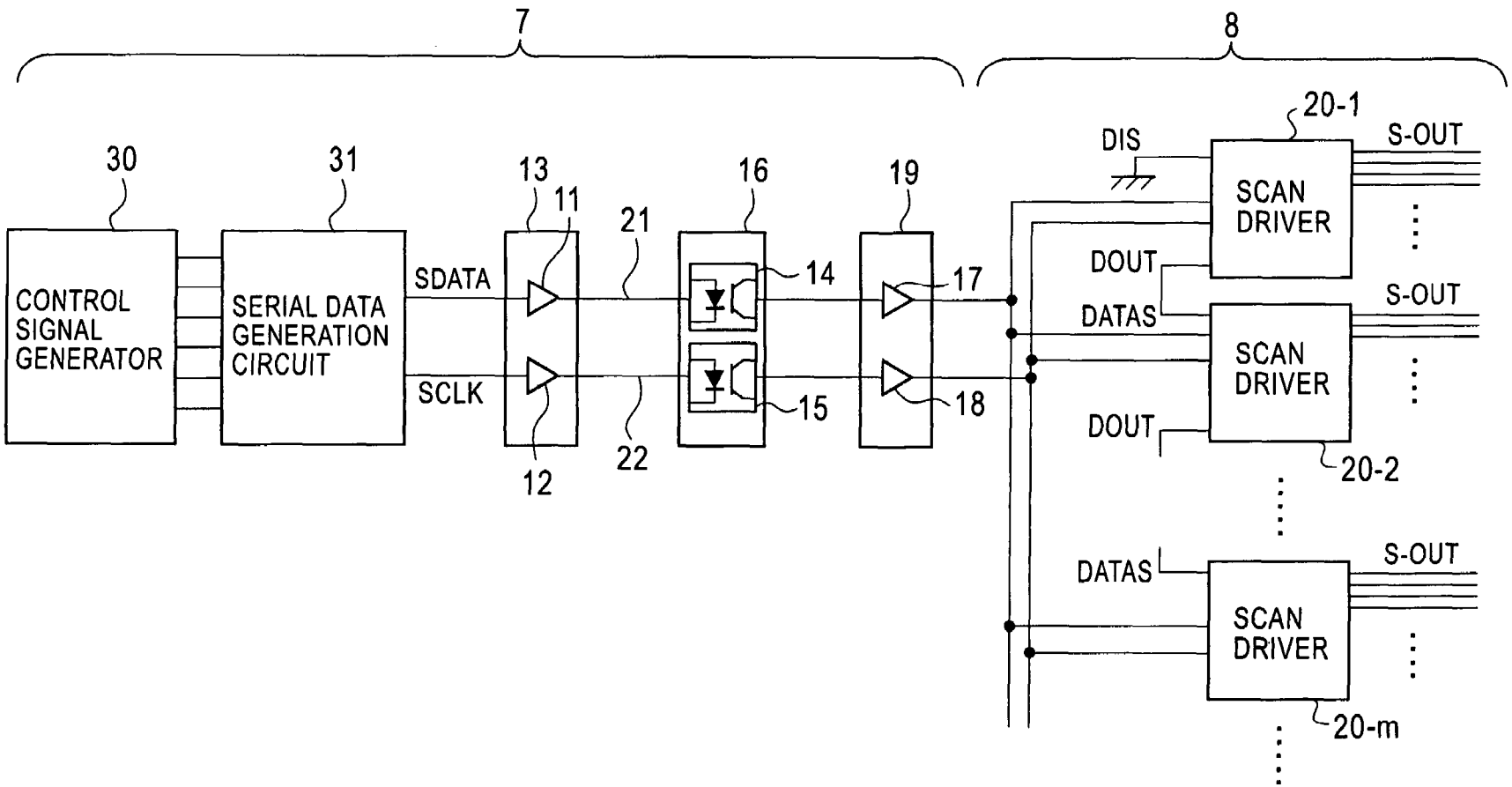
FIG. 2 is a block diagram showing a major part of the plasma display device in accordance with the first embodiment of the present invention.

FIG. 2 is a block diagram showing a partial construction of the scan driver controller 7 and the scan pulse generation circuit 8 in the plasma display device 1 shown in FIG. 1.

Referring to FIG. 2, the scan driver controller 7 is comprised of a control signal generator 30, serving as a control signal generation means for generating control signals of plural kinds (6 kinds, for example), such as a first blank signal BLK1, a second blank signal BLK2, a latch enable signal LE, a clear signal CLR, a data signal DATA, and a clock signal SCLK, a serial data generation circuit 31 for converting control signals of plural kinds generated by the control signal generator 30 into serial data and outputting the clock signal SCLK and a control signal SDATA converted into the serial data, the control signals of the plural kinds including all control signals except the clock signal SCLK, for example, a first buffer circuit group 13 consisting of two buffer circuits 11 and 12 for receiving the clock signal SCLK and the control signal SDATA converted into the serial data from the serial data generation circuit 31, a photocoupler group 16 consisting of two photocouplers 14 and 15, and a second buffer circuit group 19 consisting of two buffer circuits 17 and 18.

Further, the buffer circuits 11 and 12 included in the first buffer circuit group 13, the photocouplers 14 and 15 included in the photocoupler group 16 and the buffer circuits 17 and 18 included in the second buffer circuit group 19 are provided in equal number, and the number provided in the embodiment is 2.

Further, the scan pulse generation circuit 8 has a plurality (m) of scan drivers 20-1, 20-2, . . . , 20-m arranged sequentially.

The clock signal SCLK, and the control signal (hereinafter, referred to as "serial data" SDATA) converted into serial data by the serial data generation circuit 31 are outputted in parallel to the scan drivers 20-1, 20-2, . . . , 20-m of the scan pulse generation circuit 8 through the first buffer circuit group 13, photocoupler group 16, and second buffer circuit group 19.

That is, in the present embodiment, the scan driver controller 7 includes two signal transfer paths, a first signal transfer path 21 that is a transfer path of the serial data SDATA, and a second signal transfer path 22 that is a transfer path of the clock signal SCLK.

The first and second signal transfer paths 21 and 22 are connected to scan drivers 20-1 to 20-m, respectively.

Among them, the first signal transfer path 21 has a buffer circuit 11, a photocoupler 14 and a buffer circuit 17 arranged in this order starting from the upper stream side of the signal transfer. In the same manner, the second signal transfer path 22 has a buffer circuit 12, a photocoupler 15, and a buffer circuit 18 arranged in this order starting from the upper stream side of the signal transfer.

Among them, the photocouplers 14 and 15 electrically insulate the upper stream side of the photocouplers 14 and 15 from the down stream side thereof in each of the signal transfer paths 21 and 22.

According to this configuration, the signals input to scan drivers 20-1 to 20-m of the scan pulse generation circuit 8 are respectively guaranteed to be within tolerances of breakdown voltage characteristics of scan drivers 20-1 to 20-m.

Here, in the present embodiment, the first signal transfer path 21 transfers serial data SDATA in which a first blank signal BLK1, a second blank signal BLK2, a latch enable signal LE, a clear signal CLR and a data signal DATA are gathered in a serial data format, and the second signal transfer path 22 transfers the clock signal SCLK.

Figure 3:
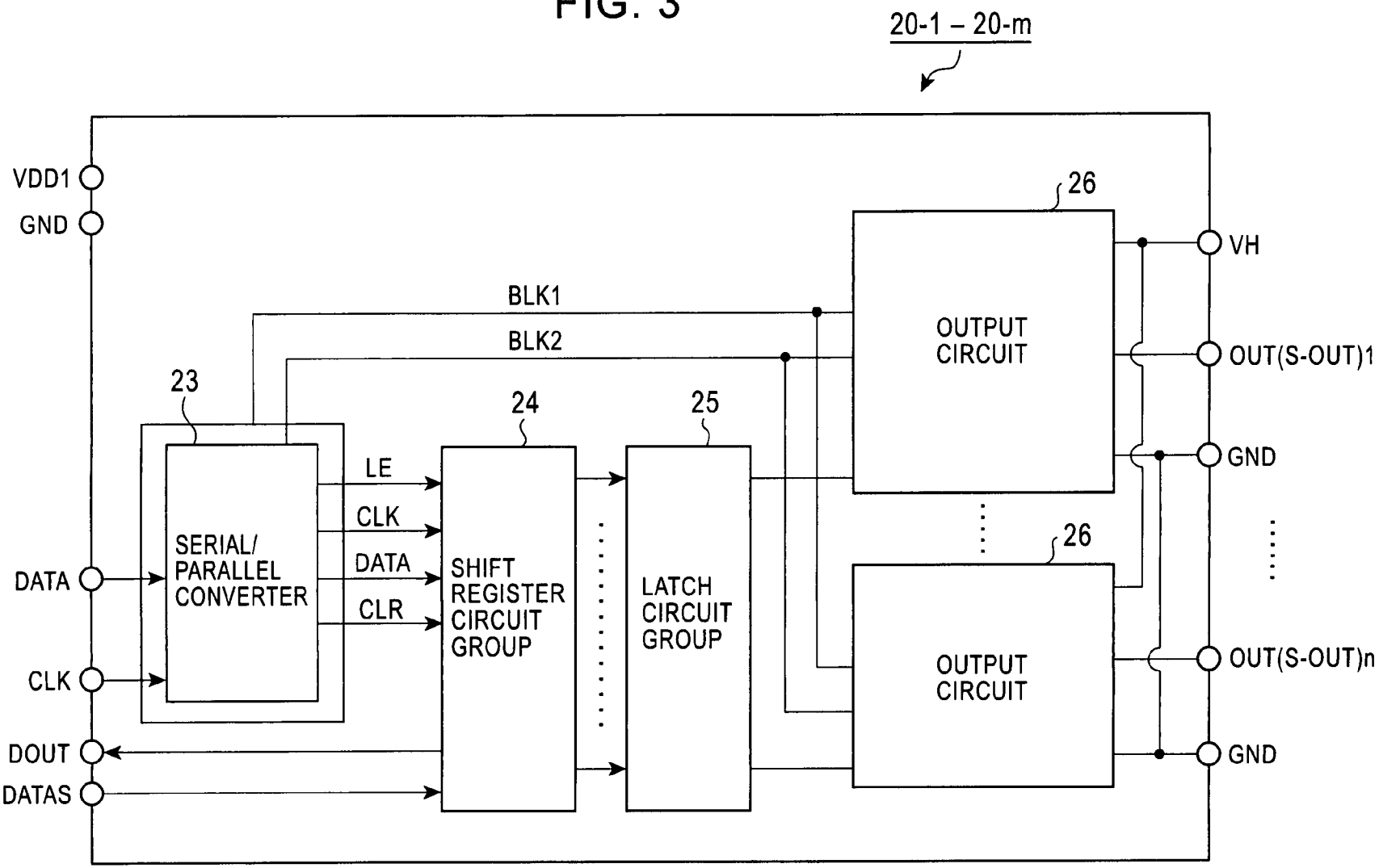
FIG. 3 is a block diagram showing data drivers (scan drivers) included in the plasma display device in accordance with the first embodiment of the present invention.

FIG. 3 is a block diagram showing a construction of the scan drivers 20-1 to 20-m included in the plasma display device 1 in accordance with the present embodiment.

The scan drivers 20-1 to 20-m are comprised of a serial/parallel converter 23 for separating the serial data input from the scan driver controller 7 into control signals of plural kinds, a shift register circuit group 24, a latch circuit group 25, and "n" output circuits 26 for outputting driving signals with respect to "n" scan electrodes (gate electrodes) included in the PDP1, respectively.

Serial data SDATA is input to the serial/parallel converter 23 from the scan driver controller 7 through the first signal transfer path 21, and a clock signal SCLK is input through the second signal transfer path 22.

The serial/parallel converter 23 performs a serial/parallel conversion with respect to the input serial data, and separates the input serial data into the control signals of original plural kinds.

In more detail, the serial/parallel converter 23 separates the input serial data into a first blank signal BLK1, a second blank signal BLK2, a latch enable signal LE, a clear signal CLR and a data signal DATA.

Next, the serial/parallel converter 23 outputs each control signal, that is, the first blank signal BLK1, the second blank signal BLK2, the latch enable signal LE, the clear signal CLR, the data signal DATA, and the clock signal CLK in parallel.

Here, the serial/parallel converter 23 outputs the first blank signal BLK1 and the second blank signal BLK2 out of the control signals to the output circuit 26, and the remaining latch enable signal LE, clear signal CLR, data signal DATA and clock signal CLK to the shift register group 24.

Further, the first blank signal BLK1 and second blank signal BLK2 are used to control a sustain electrode (common electrode) in a sustain period of PDP2.

Further, in the present embodiment, the blank signal BLK has two signals of the first blank signal BLK1 and the second blank signal BLK2, the serial data generation circuit 31 converts five control signals into serial data, the control signals being the first blank signal BLK1, the second blank signal BLK2, the latch enable signal LE, the clear signal CLR and the data signal DATA, and the serial/parallel converter 23 separates the serial data into the five control signals and outputs each control signal in parallel.

The shift register circuit group 24 has a shift register input data DATAS input thereto and outputs shift register output data DOUT.

That is, the shift register circuit group 24 is comprised of shift registers of "n" stages. When the input data DATAS is input into the shift register of a first stage, the data is transmitted to the shift register of a second stage in synchronization with a rise of the clock signal CLK.

As such, the data inputted to the shift register of the first stage in synchronization with the rise of the clock signal CLK is sequentially transmitted to shift registers of the second stage, third stage, . . . , n-th stage, and the data transmitted to the shift register of the n-th stage is output from the output terminal of the shift register as output data DOUT in synchronization with the rise of the next clock signal CLK.

The data of the shift register of the n-th stage of the scan driver 20-1 out of the m scan drivers 20-1, 20-2, . . . , 20-m of a scan pulse generation circuit 8 is outputted from an output terminal of the shift register as an output data DOUT in synchronization with the rise of the clock signal CLK, input into an input terminal of the shift register of the scan driver 20-2 as the input data DATAS, and transmitted to the shift register of the first stage of the scan driver 20-2 in synchronization with the rise of the clock signal CLK.

That is, the data of the shift register of the n-th stage of the scan driver 20-1 is transmitted to the shift register of the first stage of the scan driver 20-2 in synchronization with the clock signal CLK. In the same manner, the data of the shift register of the n-th stage of the scan driver 20-2 is transmitted to the shift register of the first stage of the scan driver 20-3, and the data of the shift register of the n-th stage of the scan driver

20-(m-1) is transmitted to the shift register of the first stage of the scan driver 20-m in synchronization with the rise of the clock signal CLK.

Accordingly, the data is sequentially transmitted to the "n×m" shift registers that are comprised of the scan drivers 20-1 to 20-m of the scan pulse generation circuit 8 in synchronization with the rise of the clock signal CLK. However, the data inputted to the shift register of the first stage of the scan driver 20-1 is not the input data DATAS input to the input terminal of the shift register of the first stage but the data signal DATA outputted from the serial/parallel converter 23.

Here, each of the scan drivers 20-1 to 20-m has an identification input terminal DIS used to determine whether each scan driver is the first scan driver 20-1, and identifies the first scan driver 20-1 when DIS is grounded, for example.

As shown in FIG. 2, while an identification input terminal DIS of the scan driver 20-1 is grounded, identification input terminals DIS of other scan drivers 20-1, . . . , 20-m are not grounded.

Figure 4:
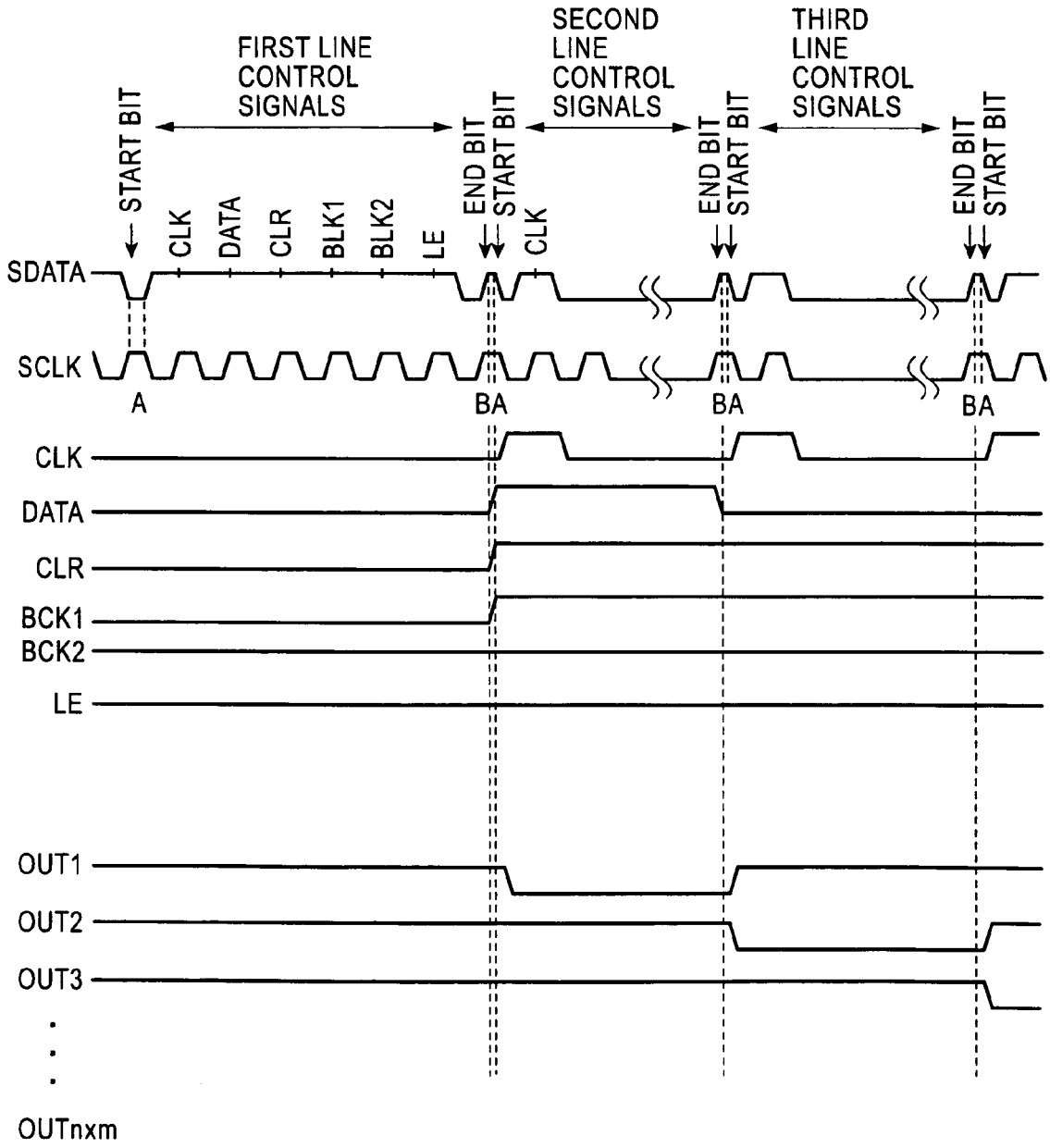
FIG. 4 is a timing chart showing input/output signals of the data drivers (scan drivers) included in the plasma display device in accordance with the first embodiment of the present invention.

FIG. 4 is a timing chart showing signals input to scan drivers 20-1 to 20-m in the scan pulse generation circuit 8 from the scan driver controller 7, and signals (scan pulses) outputted from the scan drivers 20-1 to 20-m.

Referring to FIG. 4, serial data SDATA and clock signal SCLK are input to the scan drivers 20-1 to 20-m, and n×m output signals (scan pulses: OUT1, OUT2, . . . , OUT n×m) are outputted from the scan drivers 20-1 to 20-m to the n scan electrodes (gate electrodes) included in the PDP101, respectively.

In an "A" timing shown in FIG. 4, when the clock signal SCLK is at a high level (the level just before the clock signal SCLK falls), the serial data SDATA is fallen to a low level (the level at the point of time when the serial data SDATA is in a falling edge switch), so that a start bit for signal control initiation is generated and accordingly it becomes possible to perform a determination as to other control signals.

Meanwhile, in a "B" timing shown in FIG. 4, when the clock signal SCLK is at a high level (the level at the point of time when the clock signal SCLK is in a rising edge switch), the serial data SDATA is raised to a high level (the level while the serial data SDATA is raised, before it begins to fall), so that signal control termination generates an end bit and accordingly it becomes possible to determine a commence of an output of the transmitted signals.

As shown in FIG. 4, line control signals as driving signals to drive n scan electrodes (gate electrodes) included in the PDP1 are generated in succession by a start bit defined by a high level of the clock signal SCLK and a low level of the serial data SDATA, and an end bit defined by a high level of the clock signal SCLK and a high level of the serial data SDATA. These line control signals are output from the scan drivers 20-1 to 20-m (line output) so that the scan electrodes of the PDP1 are driven respectively on the basis of each line signal.

In the example shown in FIG. 4, while the length of each line control signal (from start time to end time) is defined using a high level of the clock signal SCLK, it is also possible to define the length of each line control signal using a low level of the clock signal SCLK.

While it is not possible to define an output time of the line control signal in simple serial transmission, it is possible to define an output time of the scan operation in the PDP1 by generating a control bit on the basis of the clock signal SCLK and serial data SDATA as described above.

In FIG. 4, a timing of "A" corresponds to a start bit, a timing bit of "B" corresponds to a stop bit, and the serial data SDATA is fetched by 6 bits in synchronization with a rising timing of the clock signal SCLK after detecting the start bit. However, when detecting the stop bit, the fetch is stopped even though fetch data is less than 6 bits and fetched data is serial/parallel converted.

The serial data SDATA fetched firstly is the clock signal CLK, the serial data SDATA fetched secondly is the data signal DATA, the serial data SDATA fetched thirdly is the clear signal CLR, the serial data SDATA fetched fourthly is the first blank signal BLK1, the serial data SDATA fetched fifthly is the second blank signal BLK2, and the serial data SDATA fetched sixthly is the latch enable signal LE.

Even if the end bit is not detected, the serial data SDATA fetched seventhly and after is disregarded.

In the case that the end bit is detected before the sixth serial data SDATA is fetched, it is regarded that signals except the serial data SDATA fetched before then is not changed from the serial data SDATA fetched in the previous line. However, the serial data SDATA fetched in a rising timing of the clock signal SCLK just before the end bit is detected is disregarded.

In FIG. 4, the clear signal CLR of the serial/parallel converter 23 before the first line control signal is inputted is in the "L", and accordingly each shift register of the shift register circuit group 24 is compulsorily set to "L".

In the same manner, the first blank signal BLK1 of the serial/parallel converter 23 also is at "L", and accordingly each output OUT of the output circuit 26 is compulsorily set to "L".

In such an initial state, a control signal of 6 bits is input to the serial/parallel converter 23 by the first control signal, and the control signal of 6 bits from the start bit to the end bit is fetched from the serial/parallel converter 23 and converted into a parallel signal.

The control signal is subjected to serial/parallel conversion in synchronization with the detection of the end bit, and the data signal DATA, the clear signal CLR and the first blank signal BLK1 are changed from "L" to The clock signal CLK is raised after detecting the end bit in synchronization with the fall of the next clock signal SCLK, and then is fallen in synchronization with the fall of the clock signal SCLK.

When the serial data SDATA corresponding to the clock signal CLK fetched to the serial/parallel converter 23 is at "H", the clock signal CLK is raised in synchronization with the fall of the clock signal SCLK after detecting the end bit, and then is fallen in synchronization with the fall of the next clock signal SCLK.

When the serial data SDATA corresponding to the clock signal CLK fetched to the serial/parallel converter 23 is at "L", the clock signal CLK remains "L".

The control signals, expect for the clock signal CLK, output "H" from the serial/parallel converter 23 in synchronization with the detection of the end bit when corresponding serial data SDATA is at "H", and "L" from the serial/parallel converter 23 in synchronization with the detection of the end bit when the serial data SDATA is at "L".

In FIG. 4, only the clock signal CLK and the serial data SDATA corresponding to the data signal DATA are input as the second line control signal. That is, the clock signal SCLK in the input timing of the third control signal remains "L", and the serial/parallel converter 23 fetches the clock signal CLK, the serial data SDATA corresponding to the data signal DATA only.

Next, when the clock signal SCLK becomes to "H", the end bit is detected directly. Since the serial data SDATA corresponding to the data signal DATA of the second line control signal is at "L", the data signal DATA of the serial/parallel converter 23 is changed from "H" to "L" in synchronization with the timing where the end bit is detected. As the serial data SDATA corresponding to the clock signal CLK is at "H", the clock signal CLK is raised in synchronization with the fall of the clock signal SCLK after detecting the end bit, and is fallen in synchronization with the fall of the next clock signal SCLK. The control signal after the third line is the same as that of the second line. However, after the third line control signal, since the data signal DATA also is not changed from the previous line, only the clock signal CLK may be used as the control signal.

FIG. 5 is a view showing a signal format of serial data.

Corresponding to each bit of the 6 bits, the clock bit CLK is arranged in the least significant byte LSB and the latch enable signal LE is arranged in the most significant byte MSB. The data signal DATA, the clear signal CLR, the first blank signal BLK1 and the second blank signal BLK2 are assigned between the clock signal CLK and the latch enable signal LE starting with the LSB side.

As shown in FIG. 5, it becomes possible to reduce transmission time of the control signal by arranging the clock signal of the control signal that is used frequently in the LSB.

Further, when performing the scan output, it is possible to perform the output control simply by transmitting the clock signal CLK, e.g. repeatedly transmitting the clock signal CLK.

As described above, according to the first embodiment, at least two control signals of the control signals of plural kinds generated to perform operational control of the scan drivers 20-1 to 20-m are converted into serial data and outputted to the scan drivers 20-1 to 20-m. For example, the first blank signal BLK1, the second blank signal BLK2, the latch enable signal LE, the clear signal CLR and the data signal DATA are converted into serial data among the control signals of plural kinds such as the first blank signal BLK1, the second blank signal BLK2, the latch enable signal LE, the clear signal CLK, the data signal DATA and the clock signal CLK and are outputted to the scan drivers 20-1 to 20-m (serially transmitted). Accordingly, it is possible to reduce the number of transfer paths of the control signal in comparison with the conventional art.

In more detail, while six signal transfer paths, that is, the first to sixth signal transfer paths 121 to 126 are needed in the conventional driving circuit, the same function can be obtained with two signal transfer paths of the first and second signal transfer paths 21 and 22 in the present embodiment.

Accordingly, the cost of the driving circuit can be reduced in proportion to the reduced number of the transfer paths of the control signals, and the size of the circuit can be reduced, simultaneously.

In particular, in the case that the driving circuit includes expensive photocouplers as insulators to isolate the upper stream side of the signal transfer path from the down stream side thereof, it is possible to reduce the number of the transfer paths of the control signal as described above. Accordingly, since it is also possible to reduce the number of the photocouplers, it is possible to considerably reduce the manufacturing costs of the driving circuit.

Further, by reducing the number of the signal transfer paths, it is possible to reduce the number of the buffer circuits 11 and 17 in the buffer circuit groups 13 and 19 as well as the number of the photocouplers.

According to the first embodiment, in the driving circuit having scan drivers 20-1 to 20-m for outputting image signals to display an image in the PDP2, and the scan driver controller 7 to control the operations of the scan drivers 20-1 to 20-m on the basis of the input image signal, since the scan driver controller 7 includes the control signal generator 30 for generating the control signals of plural kinds on the basis of the image signal and the serial data generation circuit 31 for converting at least two control signals out of the control signals of plural kinds generated by the control signal generator 30, the scan drivers 20-1 to 20-m include the serial/parallel converter 23 for separating the serial data output from the scan driver controller 7 into the control signals of plural kinds, at least two control signals out of the control signals of plural kinds generated to perform the operation control of the scan drivers 20-1 to 20-m are converted into serial data and outputted to the scan drivers 20-1 to 20-m. Accordingly, the number of the transfer paths of the control signals can be reduced in comparison with the conventional art.

Second Embodiment

Figure 6:
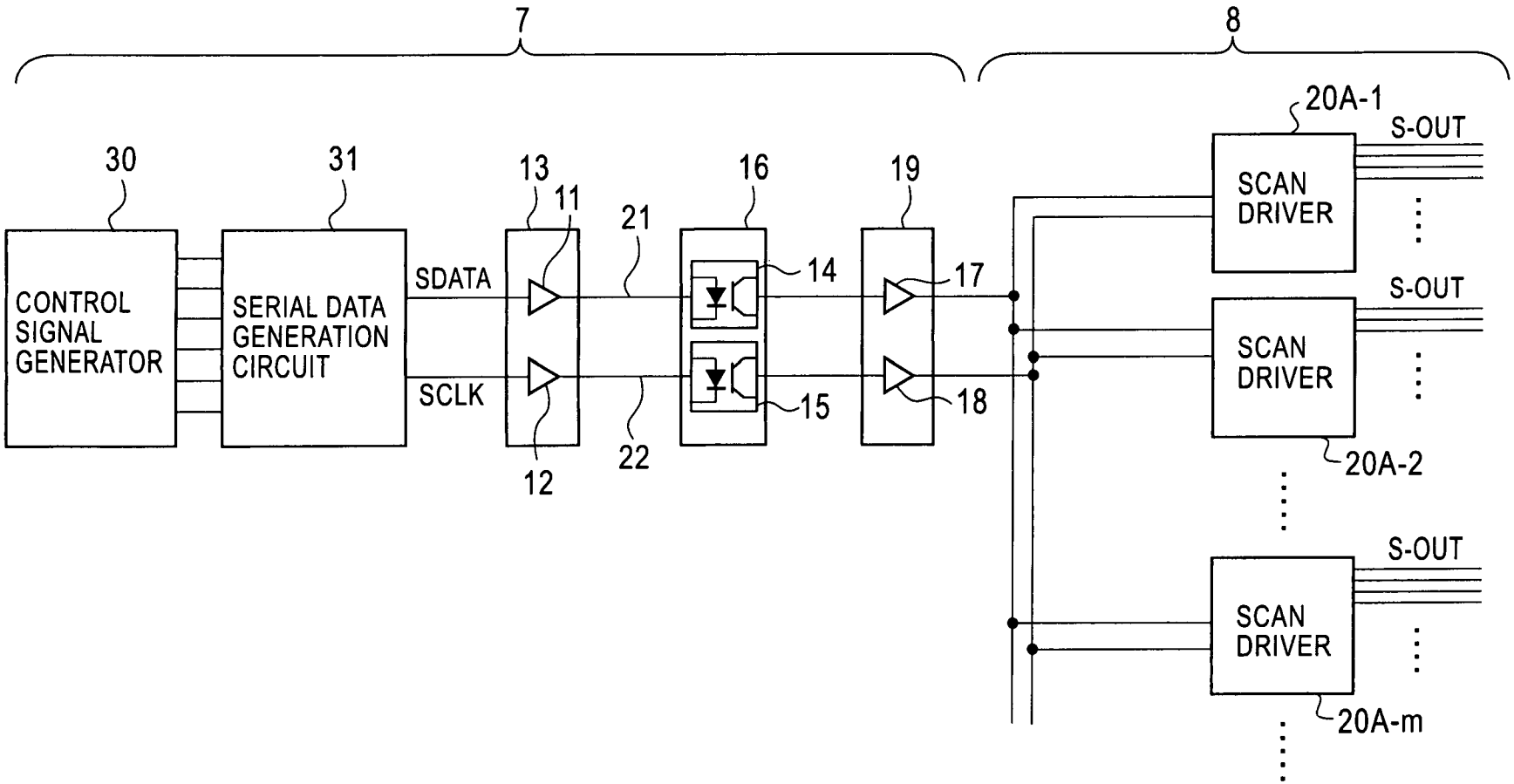
FIG. 6 is a block diagram showing a major part of the plasma display device in accordance with a second embodiment of the present invention.

FIG. 6 is a block diagram showing a major part of the plasma display device in accordance with a second embodiment of the present invention.

The plasma display device in accordance with the second embodiment has a similar construction to that of the first embodiment except for differences that will be described below. Accordingly, the elements of the plasma display device according to the second embodiment that are the same as those of the plasma display device according to the first embodiment are denoted by the same numerals and a detailed explanation thereof will be omitted.

As shown in FIG. 6, in the second embodiment, the scan pulse generation circuit 8 includes m scan drivers 20A-1 to 20A-m.

As shown in FIG. 6, in the second embodiment, differently from the first embodiment shown in FIG. 2, the shift register output data DOUT of the scan drivers 20A-1 to 20A-m and the register input data DATAS that are adjacent are not connected to one another. Accordingly, terminals of the DOUT and DATAS are not needed in the scan drivers 20A-1 to 20A-m.

Further, in the second embodiment, each of the scan drivers 20A-1 to 20A-m determines its own identification number according to grounding of the identification input terminal DIS (plural) (omitted in FIG. 6).

Figure 8:
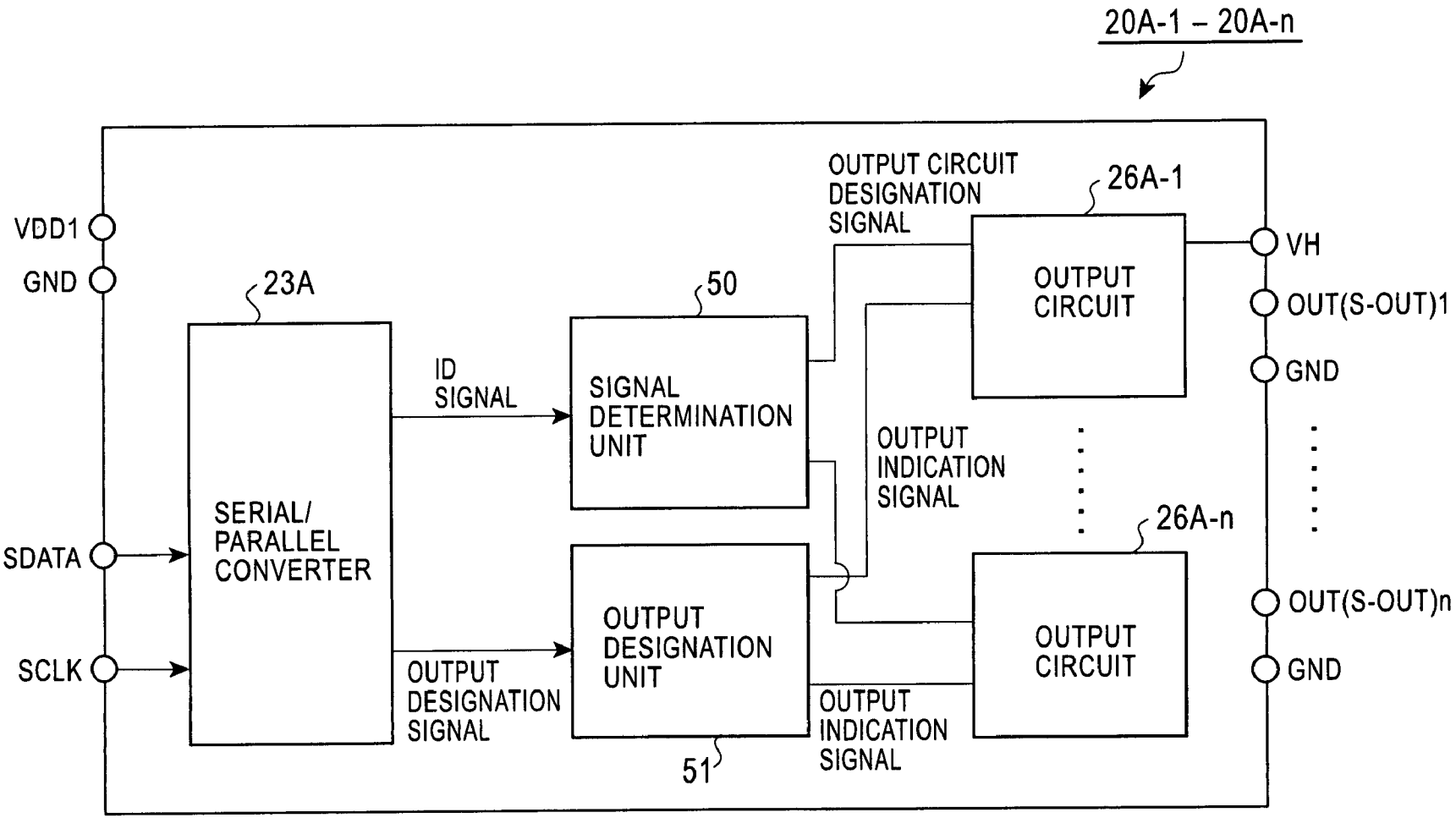
FIG. 8 is a block diagram showing a data driver (scan driver) included in the plasma display device in accordance with the second embodiment of the present invention.

FIG. 7A, 7B are showing signal format of the control signal used in the plasma display device in accordance with the second embodiment, and FIG. 8 is a block diagram showing a data driver (scan driver) included in the plasma display device in accordance with the second embodiment.

As shown in FIG. 8, in the second embodiment, each of the scan drivers 20A-1 to 20A-m is comprised of a serial/parallel converter 23A for separating serial data input from the scan driver controller 7 into the control signals of plural kinds, a signal determination unit 50, an output designation unit 51, and n output circuits 26A-1 to 26A-n for outputting corresponding driving signals to n scan electrodes (gate electrodes) included in the PDP1, respectively.

First, the format will be described with reference to FIG. 7.

As shown in FIG. 7A, an ID signal and an output designation signal are arranged between the start bit and the stop bit.

Among them, the ID signal is a signal to designate the scan drivers 20A-1 to 20A-m of the device to be controlled. In a case that the scan drivers 20A-1 to 20A-m are mounted on the corresponding display device, the ID signal represents a designation of any one of the scan drivers, or all scan drivers, or none of the scan drivers.

In the case that at least one of the scan drivers 20A-1 to 20A-m is designated, an output designation signal designates outputs of the output circuits 26A-1 to 26A-n mounted on the designated scan driver.

Next, referring to FIG. 8, operation using the format shown FIG. 7A will be additionally described.

The serial/parallel converter 23 performs serial/parallel conversion with respect to the input serial data, separates the serial data into an ID signal and an output designation signal, and outputs the ID signal to the determination unit 50 and the output designation signal to the output designation unit 51.

The signal determination unit 50 and output designation unit 51 perform signal analysis on the basis of the ID signal and the output designation signal, respectively.

That is, in the case that the ID signal designates the corresponding driver or all scan drivers, the signal determination unit 50 activates the output circuit designation signal input to the output circuits 26A-1 to 26A-n. In synchronization therewith, the output designation unit 51 analyzes the output designation signal, and outputs the output designation signals that are input to the output circuits 26A-1 to 26A-n according to the result of the analysis. Further, in the case that the corresponding scan driver is not designated, the output circuit designation circuit remains inactive.

Simple scan driving is performed in the first embodiment, where only one of the output circuits 26-1 to 26-n is sequentially low in level and the remaining circuits remain high in level. However, while only one scan driver can be designated in the second embodiment, multiple output circuits 26A-1 to 26A-n among the designated scan drivers can be designated.

Next, a case of the format shown in FIG. 7B will be described.

As shown in FIG. 7B, the ID signal S1, the ID signal S2, and the output designation signal are arranged between the start bit and the stop bit.

Among these, the ID signals S1 and S2 are signals to designate the driver 20 to be controlled. When the scan drivers 20A-1 to 20A-m are mounted on the corresponding display device, the ID signals S1 and S2 indicate whether one of the scan drivers is designated, whether all of the scan driver are designated, or whether no scan driver is designated. In the case that at least one of the scan drivers 20A-1 to 20A-m is designated, the ID signal S2 indicates which output circuit is designated among the output circuits 26A-1 to 26A-n among the designated scan drivers.

The output of the output circuits (anyone of the outputs 26A-1 to 26A-n) designated by the ID signal S2 is designated by the output designation signal. In the case that the output is simply either ON or OFF, 1 bit is sufficient. However, when 3 or more different output voltages are utilized, 2 or more bits are needed. Such high level control can be performed in the present embodiment.

Next, referring to FIG. 8, an operation for the case of the format shown in FIG. 7B is described.

The serial/parallel converter 23 performs serial/parallel conversion for the input serial data, separates the serial data into the ID signals S1 and S2, and the output designation signal, and outputs the ID signals S1 and S2 to the signal determination unit 50 and the output designation signal to the output designation unit 51.

The signal determination unit 50 and the output designation unit 51 perform the signal analysis on the basis of the ID signals S1 and S2 and the output designation signal, respectively.

That is, in the case that the ID signal S1 designates the corresponding scan driver, the signal determination 50 additionally detects that any one of the output circuits 26A-1 to 26A-n is designated by the ID signal S2, and make the output circuit designation signal input to the designated output circuit (anyone of the output circuits 26A-1 to 26A-n) active. In synchronization with this operation, the output designation unit 51 analyzes the output designation signal, and outputs the output designation signal input to the output circuits 26A-1 to 26A-n according to the result of the analysis.

Further, in the case that the ID signal S1 designates all of the scan drivers, the signal determination unit 50 activates the output circuit designation signal input to the output circuits 26A-1 to 26A-n. In synchronization with this operation, the output designation unit 51 analyzes the output designation signal, and outputs the output circuit designation signal input to the output circuit 26A-1 to 26A-n according to the result of the analysis. Further, in the case that the corresponding scan driver is not designated, the output circuit designation signal remains inactive.

Simple scan driving is described in the first embodiment, wherein only one of the output circuits 26A-1 to 26A-n is sequentially low in level and the remaining output circuits remain high in level. However, it is possible to designate the output voltages of the output circuits 26A-1 to 26A-n in the second embodiment by utilizing 2 or more bits for the output designation signal 2. Further, it is possible to designate the plural output circuits 26A-1 to 26A-n by increasing the number of bits of the ID signal S2.

As described above, in accordance with the second embodiment, it is possible to provide a higher degree of freedom, and to freely designate the scan order, the number of simultaneous scans, and scan voltage of the scan driver, compared with the first embodiment.

Third Embodiment

Figure 9:
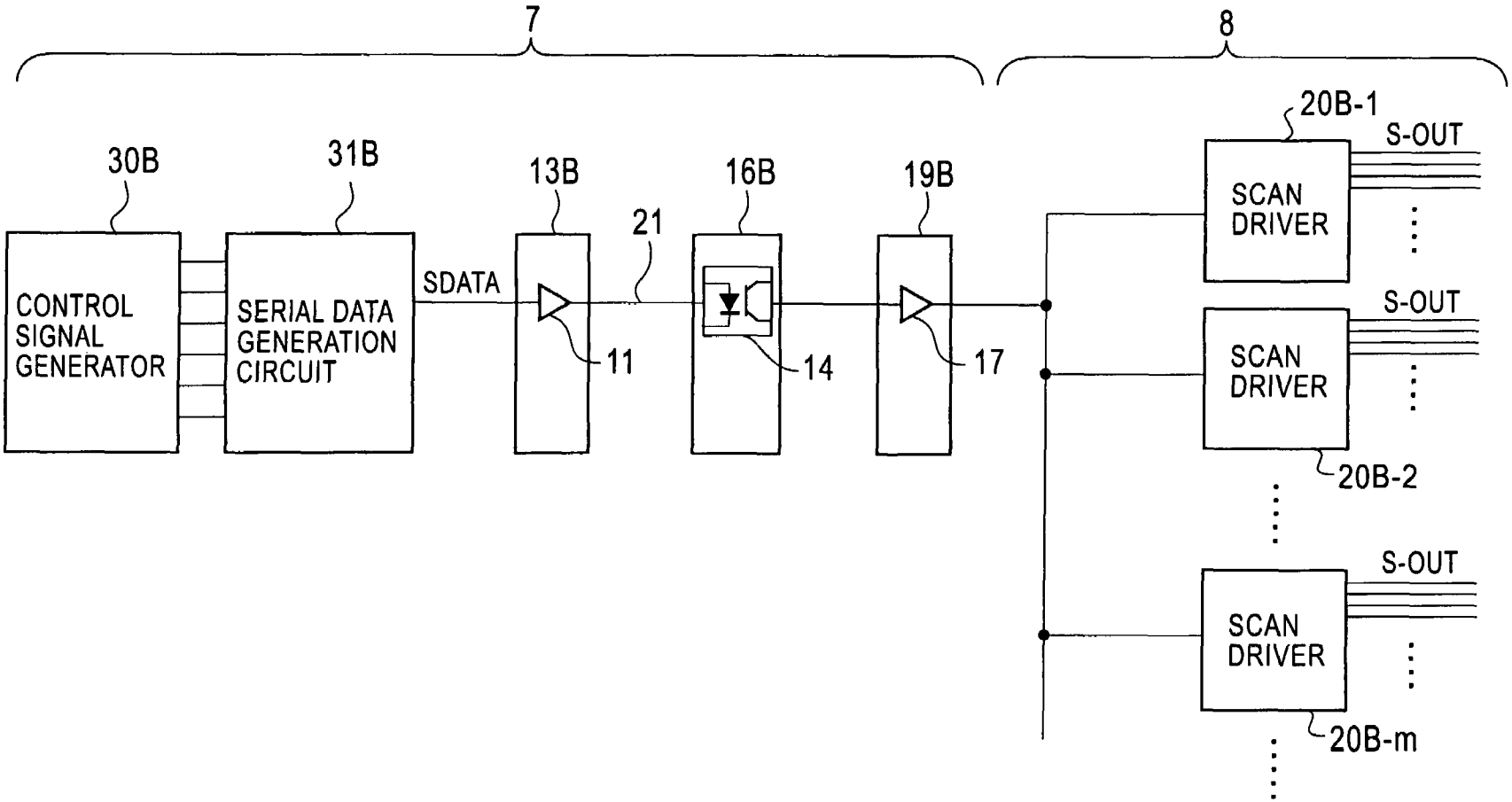
FIG. 9 is a block diagram showing a major part of the plasma display device in accordance with a third embodiment of the present invention.

FIG. 9 is a block diagram showing a major part of the plasma display device in accordance with a third embodiment of the present invention.

The plasma display device in accordance with the third embodiment has the same construction as that of the second embodiment except for differences to be described below. Accordingly, the elements of the plasma display device according to the third embodiment that are the same as those of the plasma display device according to the second embodiment are assigned the same numerals and an explanation thereof will be omitted.

As shown in FIG. 9, in the third embodiment, the scan driver controller 7 includes a control signal generator 30B, a serial data generation circuit 31B, a first buffer 13B, a photocoupler 16B, and a second buffer 19B.

Among them, the control signal generator 30B is different from the control signal generator 30 of the second embodiment only in that the generator 30B does not generate and output the clock signal SCLK.

Further, the first buffer 13B consists of one buffer circuit 11, the photocoupler 16B consists of one photocoupler 14, and the second buffer 19B consists of one buffer circuit 17.

As such, the plasma display device in accordance with the third embodiment is different from that in accordance with the second embodiment in that the second signal transfer path 22 that is a transfer path of the clock signal SCLK is omitted.

Further, in the third embodiment, the scan pulse generation circuit 8 includes m scan drivers 20B-1 to 20B-m, and the serial data SDATA that is transferred through the first signal transfer path 21 is input to each of the scan drivers 20B-1 to 20B-m.

In the third embodiment, the format of the control signal is the same as that of the second embodiment (FIGS. 7A, 7B). However, the signal corresponding to the clock signal SCLK is outputted between the stop bit and the start bit from the serial data generation circuit 31B.

Figure 10:
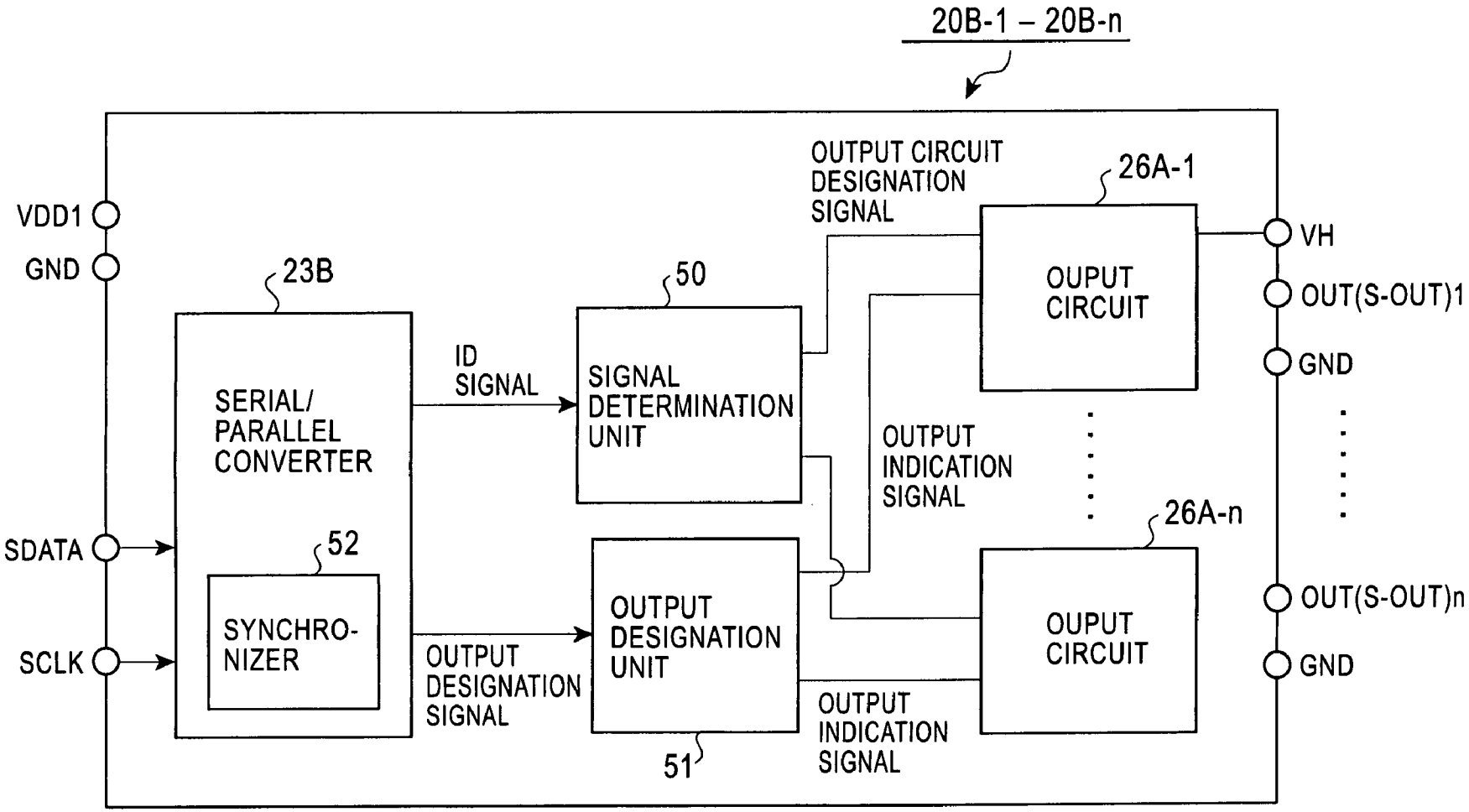
FIG. 10 is a block diagram showing a data driver (scan driver) included in the plasma display device in accordance with the third embodiment of the present invention.
Figure 11:
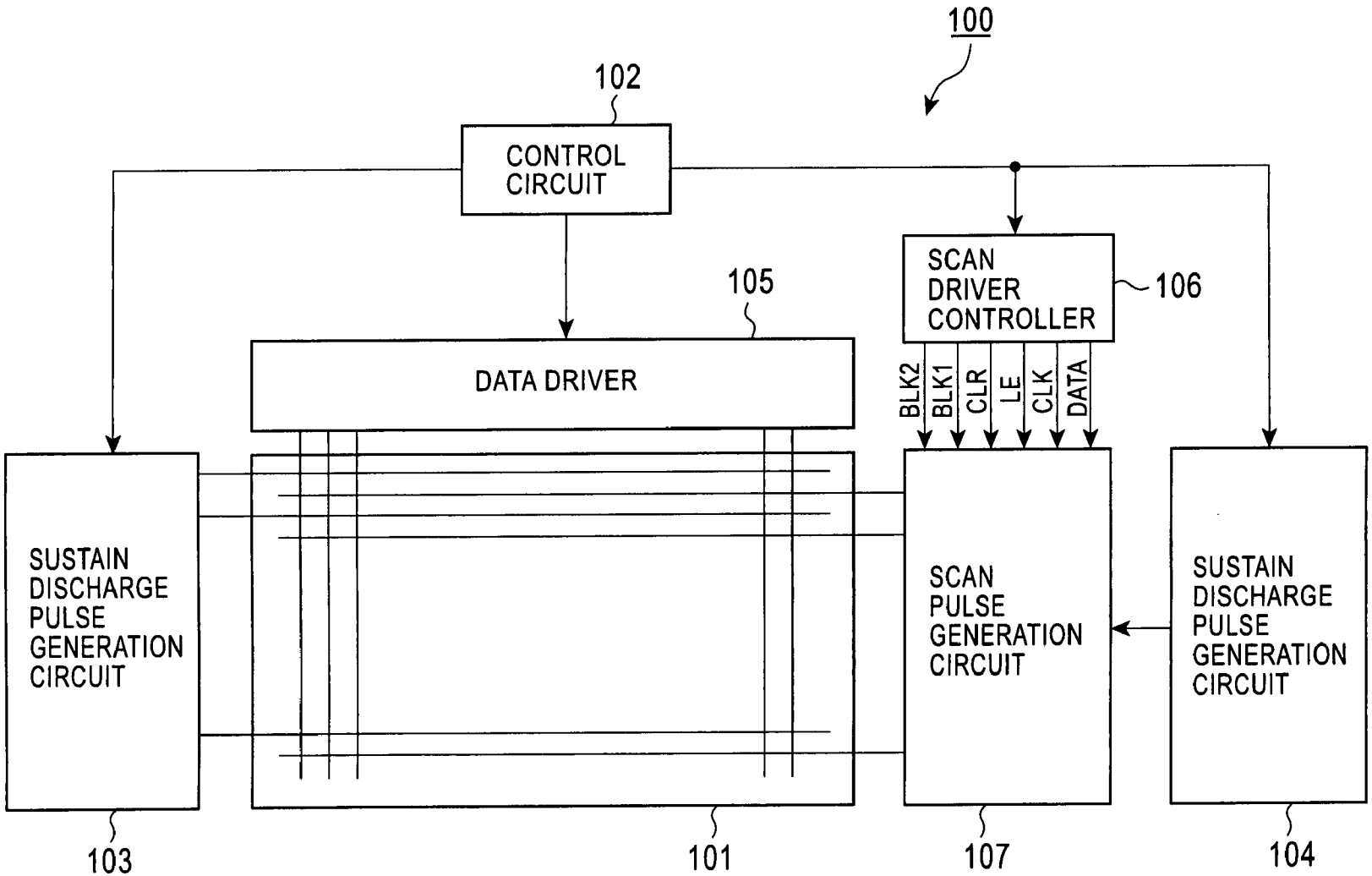
FIG. 11 PRIOR ART
FIG. 11 is a signal processing block diagram of a conventional plasma display device.
Figure 12:
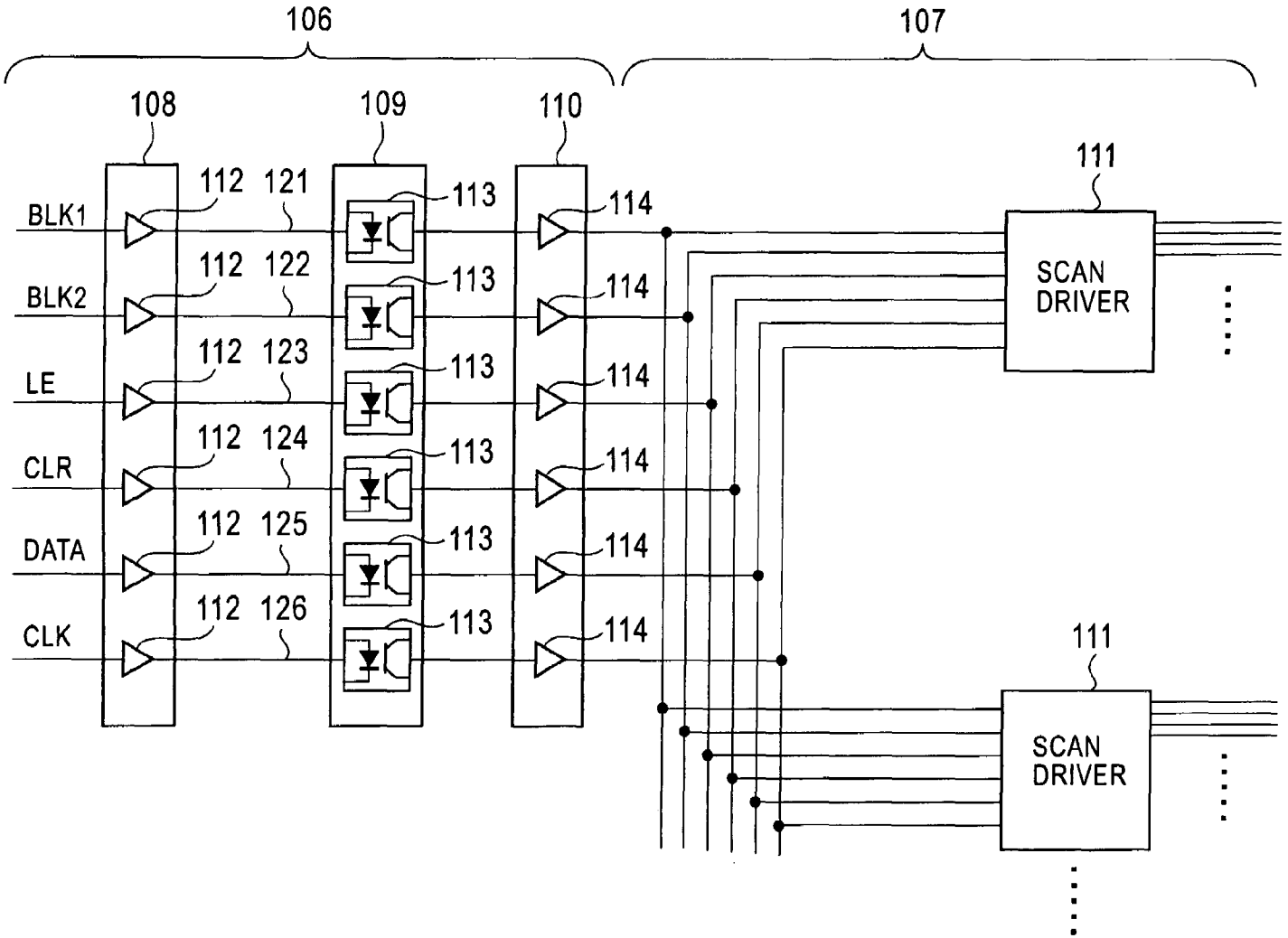
FIG. 12 PRIOR ART
FIG. 12 is a block diagram showing a major part of the plasma display device shown in FIG. 11.
Figure 13:
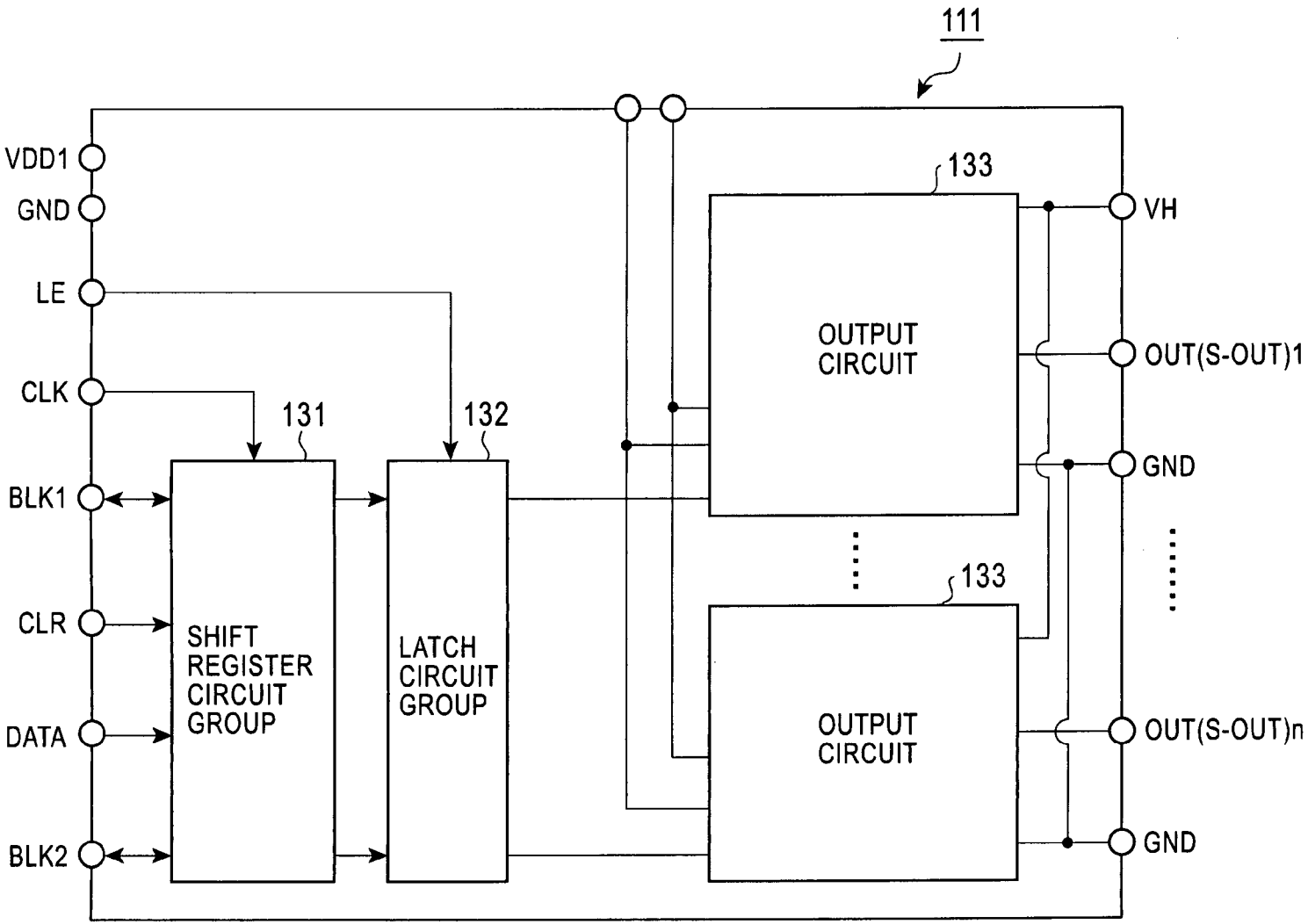
FIG. 13 PRIOR ART
FIG. 13 is a block diagram showing a data driver included in the plasma display device shown in FIG. 11.
Figure 14:
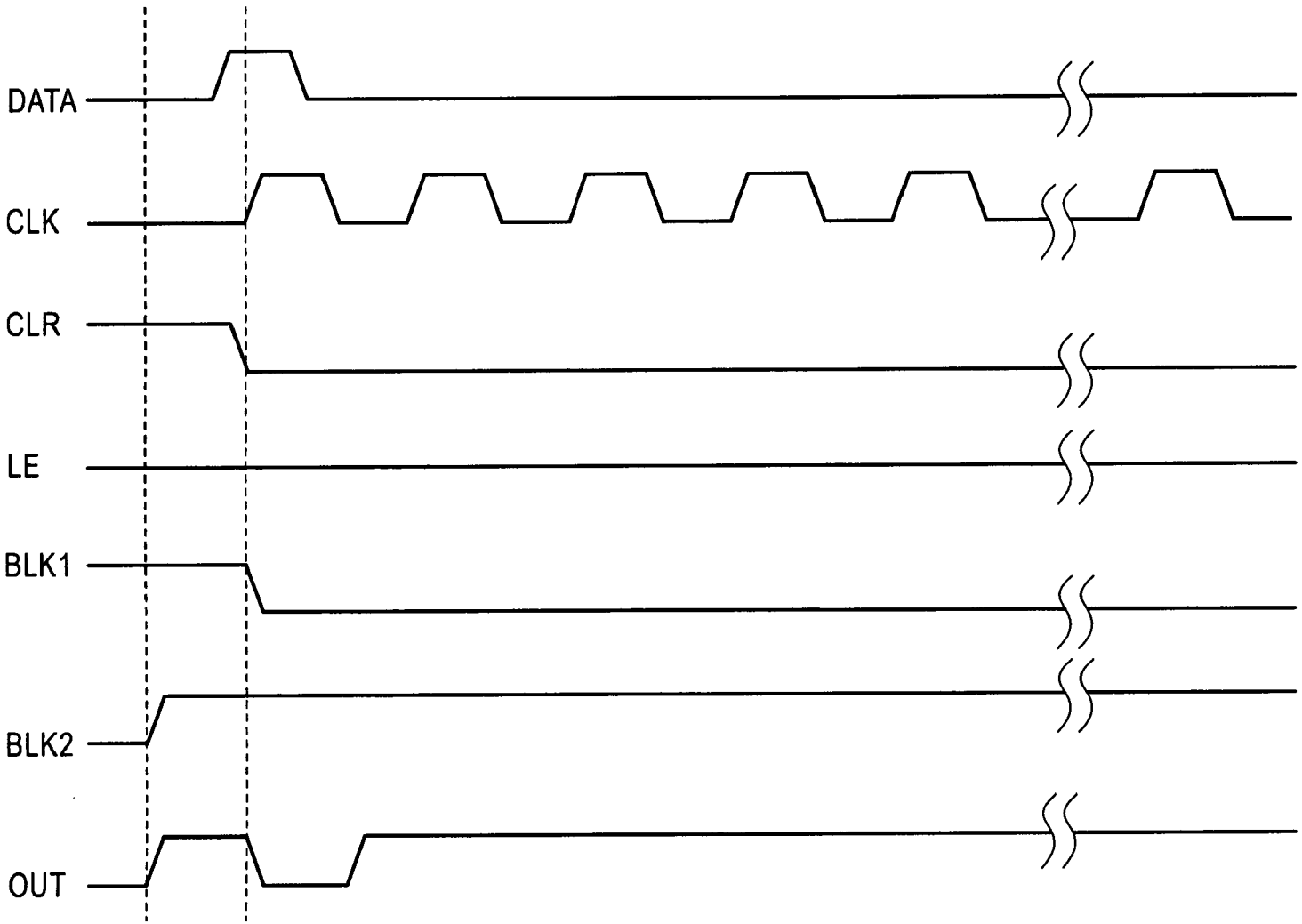
FIG. 14 PRIOR ART
FIG. 14 is a timing chart showing input/output signals of the data driver of the plasma display device shown in FIG. 11

FIG. 10 is a block diagram showing a data driver (scan driver) included in the plasma display device in accordance with the third embodiment.

As shown in FIG. 10, the third embodiment is different from the second embodiment (FIG. 8) in that there is no input signal SCLK and a synchronizer 52 is provided in the serial/parallel converter 23B.

Next, operation according to the third embodiment will be described.

When the serial data generation circuit 31B does not output the control signal, it outputs the clock signal SCLK. The serial/parallel conversion circuit 23B of the scan drivers 20B-1 to 20B-m includes the synchronizer 52. The synchronizer 52 serves to detect the clock signal SCLK from the serial data, and performs a synchronization operation.

That is, the synchronization is performed by the clock signal SCLK that detects an internal clock signal CCLK. Whenever the internal clock signal CCLK detects the clock signal SCLK, it is newly synchronized with the clock signal so that the internal clock signal CCLK is always identical in phase to the clock signal SCLK.

According to the third embodiment, it is possible to obtain the same effect as the second embodiment and to additionally eliminate one photocoupler as compared with the second embodiment.

Further, in the first to third embodiments, although the photocouplers 14 and 15 are exemplified as the insulators arranged in the first and second signal transfer paths 21 and 22, the insulator is not limited to the photocoupler. It is possible to use a pulse transformer or other devices as the insulator, for example.

Further, although the plasma display device 1 is exemplified as the display device in the first to third embodiments, the application range of the present invention is not limited to the plasma display device. That is, the present invention can also be applied to other display devices that display images according to the same principles as those employed in the plasma display device.

While the present invention has been described and illustrated herein with reference to the preferred embodiment thereof, it will be apparent to those skilled in the art that various modifications and substitutions can be made therein without departing from the spirit and scope of the invention. Thus, it is intended that the present invention covers the modifications and variations of this invention that come within the scope of the appended claims and their equivalents.

This application is based on Japanese Patent Application No. 2004-275485 which is hereby incorporated by reference.

What is claimed is:

1. A driving circuit of a display device comprising:

a scan pulse generation circuit having a plurality of scan drivers for outputting an image signal to a display for displaying an image, each of the plurality of scan drivers having a plurality of output circuit, and a controller for controlling an operation of the plurality of scan drivers and output circuits of the plurality of scan drivers on the basis of an input image signal, wherein the controller comprises a control signal generator for generating a first control signal and a second control signal for transmission to the plurality of scan drivers on the basis of the image signal; and a serial data generator for converting the first control signal and the second control signal generated by the control signal generator into serial data, the first control signal designating a scan driver of the plurality of scan drivers and the second control signal designating a plurality of output circuit of a designated scan driver, and each of the plurality of scan drivers comprises a serial/parallel converter for separating the serial data output from the serial data generator into the first control signal and the second control signal.

2. The driving circuit of the display device according to claim 1, wherein the control signal generator generates the first control signal and the second control signal according to any one of a scan order, the number of simultaneous scans, and scan voltage of the designated scan driver.

3. The driving circuit of the display device according to claim 1, further comprising an insulator to electrically insulate an upper stream side of a signal transfer path of the first control signal and the second control signal from a down stream, side, the signal transfer path being extended from the control signal generator to the serial data generator, wherein the plurality of scan drivers operate in a floating mode.

4. The driving circuit of the display device according to claim 1, wherein each of the plurality of scan drivers includes a signal determining portion to determine an output circuit of a designated scan driver to generate an output circuit designation signal.

5. A display device having a driving circuit according to claim 1, including a display for being driven by the driving circuit and for displaying an image on the basis of the image signal.

* * * * *